US006062428A

United States Patent [19]

Callahan

[11] Patent Number: 6,062,428

[45] Date of Patent: May 16, 2000

[54] VISCID PRODUCT DISPENSER

[76] Inventor: Sean P. Callahan, 127 Cortland Cir., Leominster, Mass. 01453

[21] Appl. No.: 09/124,477

[22] Filed: Jul. 29, 1998

[51] Int. Cl.[7] ..... B67D 5/00

[52] U.S. Cl. ..... 222/80; 222/387; 222/391

[58] Field of Search ..... 222/80, 387, 391, 222/390, 392

[56] References Cited

U.S. PATENT DOCUMENTS

| | | | |
|---|---|---|---|
| 1,083,887 | 1/1914 | Matthews | 222/80 |
| 1,943,194 | 1/1934 | Vachoux . | |
| 2,383,536 | 8/1945 | Elliot | 222/80 X |
| 2,533,282 | 12/1950 | Osman . | |
| 3,132,772 | 5/1964 | Bristow . | |
| 3,611,951 | 10/1971 | Sloan . | |
| 3,750,913 | 8/1973 | Wild . | |
| 4,090,646 | 5/1978 | Dubiel et al. . | |
| 4,793,521 | 12/1988 | Steiner | 222/387 X |
| 4,932,094 | 6/1990 | McCowin . | |
| 4,986,454 | 1/1991 | Robards, Jr. et al. . | |
| 5,150,820 | 9/1992 | McGill . | |
| 5,323,931 | 6/1994 | Riley . | |
| 5,341,958 | 8/1994 | Bayat et al. . | |
| 5,464,120 | 11/1995 | Alpers et al. . | |
| 5,620,115 | 4/1997 | McGill . | |

*Primary Examiner*—Kevin Shaver
*Assistant Examiner*—Thach Bui
*Attorney, Agent, or Firm*—Iandiorio & Teska; Jason D. Shanske

[57] ABSTRACT

A sanitary self sealing viscid product dispenser includes a storage chamber, having an upper end and a lower end, for storing a product to be dispensed; a dispensing device, adjacent the lower end, for dispensing the product; a plunger device, having a piston and a shaft, for compressing the product within the storage chamber toward the dispensing device; a ratchet driven transmission system engaging the shaft to dispense a predetermined amount of the product; a top portion, for covering the upper end and housing the transmission system; a self-cleaning cutting device, adjacent the dispensing device, for simultaneously cutting the product and sealing the dispensing device; and a dual action lever for actuating the transmission system in a first position to dispense the predetermined amount of the product and a second position for actuating the cutting device to cut the product, sealing the dispensing device.

63 Claims, 11 Drawing Sheets

VISCID PRODUCT DISPENSER

FIELD OF INVENTION

This invention relates to a dispenser for dispensing viscid products, and more particularly to a dispenser which synchronously dispenses a measured portion of product quickly, cleanly and sanitarily.

BACKGROUND OF INVENTION

From school and college cafeterias to military dining facilities and restaurants, there is a growing need to be able to feed large numbers of people quickly and efficiently and in a sanitary manner. When feeding large numbers of people a la carte, it is important to not only dispense certain foods in a sanitary manner, but to dispense them in a portion controlled manner in order to make cost effective use of the product to be dispensed.

Moreover, much food is wasted because it is not completely used, left out uncovered and exposed to airborne bacteria and germs, as well as to those carried by humans and insects, preventing further use. Further, containers of foods such as jelly and peanut butter as well as cream cheese and the like, when used by many people, become messy and sticky, as well as the utensils used to apply them, making them even more unappealing and unappetizing. Moreover, they often become contaminated by each other when the same utensil is used to apply the different products. Not only is the food affected, but so too are the areas in which the food is located, requiring repeated clean up, wasting labor and further adding to the unappealing and unappetizing appearance of the food products.

Finally, many dispensers currently used require electric power to operate, limiting their placement and creating congested areas in the dining facility.

SUMMARY OF INVENTION

It is therefore an object of this invention to provide an improved product dispenser which dispenses a measured portion of product.

It is a further object of this invention to provide such dispenser which dispenses the product in a sanitary manner.

It is a further object of this invention to provide such a dispenser which cuts the product after dispensing to eliminate messy spillage of the product.

It is a further object of this invention to provide such a dispenser which is self cleaning after dispensing each portion.

It is a further object of this invention to provide such a dispenser which automatically seals itself after dispensing each portion.

It is after object of this invention to provide such a dispenser which does not require electric power and can be remotely located anywhere.

The invention results from the realization that a truly efficient and sanitary product dispenser can be achieved with a product dispenser having a ratchet driven, synchronized transmission and a cutting blade, responsive to a dual action lever, for dispensing a portion controlled amount of product when the lever is actuated and simultaneously, sanitarily cutting the dispensed product and sealing the dispenser until the next use.

This invention features a sanitary self sealing viscid product dispenser including a storage chamber, having an upper end and a lower end, for storing a product to be dispensed, dispensing means, adjacent the lower end, for dispensing the product, plunger means, having a piston and a shaft, for urging the product within the storage chamber toward the dispensing means, and a ratchet driven transmission system engaging the shaft for dispensing a predetermined amount of product. There is a top portion, for covering the upper end and housing the transmission system, self-cleaning cutting means, adjacent the dispensing means, for simultaneously cutting the product and sealing the dispensing means. There is a dual action lever, for actuating the transmission system in a first position to dispense the predetermined amount of product and actuating said cutting means to cut the product, sealing the dispensing means.

In a preferred embodiment there may be reset means, responsive to the lever, to return the lever to the second position. There may be drive means, responsive to the lever, for actuating the transmission means. There may be actuating means, responsive to the dual action lever, for actuating the drive means. The transmission means may include ratchet drive means, responsive to the drive means, for engaging the shaft. The transmission means may include gear means, responsive to the ratchet drive means, for engaging the shaft. The gear means may include a first gear for engaging the shaft and a second gear for engaging the first gear and the ratchet drive means. The drive means may include a drive plate, responsive to the actuating means, for actuating the ratchet drive means. The shaft may be notched. The first gear may include worm gear means for engaging the shaft and bevel gear means for engaging the second gear. There may be belt means, responsive to the ratchet drive, for engaging the second gear. There may be second reset means, responsive to the actuating means, for returning the lever to the second position. The lever may include a lower arm for actuating the cutting means. The lower arm may include a slotted hinge for actuating the cutting means. The cutting means may include a cutting blade for cutting the product. The cutting means may include a cutting blade housing, for cleaning the blade. The blade may include a rounded cutting edge. The blade may include a beveled cutting edge. The blade may include a squared cutting edge. The reset means may include spring means, responsive to the drive plate, for returning the lever to the second position. The second reset means may include first and second spring means, responsive to the actuating means, for returning the lever to the second position.

In another embodiment the shaft may be threaded. The first gear may include an altered spur gear for engaging the shaft. The said second gear may include a spur gear for engaging the altered spur gear and the ratchet drive means. The ratchet drive means may include worm gear means for engaging the second gear. There may be second reset means, responsive to the actuating means, for returning the lever to the second position. The lever may include a lower arm for actuating the cutting means. The lower arm may include a slotted hinge for actuating the cutting means. The cutting means may include a cutting edge for cutting the product. The cutting means may include a cutting blade housing, for cleaning the blade. The blade may include a rounded cutting edge. The blade may include a beveled cutting edge. The blade may include a squared cutting edge. The reset means may include spring means, responsive to the drive plate, for returning the lever to the second position. The second reset means may include first and second spring means, responsive to the actuating means, for returning the lever to the second position. The first gear may include an altered bevel gear for engaging the shaft. The second gear may include a bevel gear for engaging the altered bevel gear and the ratchet drive means. The second gear may engage the ratchet drive means by being mounted on the ratchet drive means.

In yet another embodiment, the ratchet drive means may include a slide ring, responsive to the actuating means, for engaging the shaft. The slide ring may include a spring loaded pawl for engaging the shaft. The reset means may include spring means, responsive to the slide ring, for returning the lever to the second position. The ratchet drive means may include a second spring loaded pawl for maintaining the shaft in a fixed position as the reset means returns the lever to the second position. There may be second reset means, responsive to the actuating means, for returning the lever to the second position. The lever may include a lower arm for actuating the cutting means. The lower arm may include a slotted hinge for actuating the cutting means. The cutting means may include a cutting blade for cutting the product. The cutting means may include a cutting blade housing, for cleaning the blade. The blade may include a rounded cutting edge. The blade may include a beveled cutting edge. The blade may include a squared cutting edge. The reset means may include spring means, responsive to the slide ring, for returning the lever to the second position. The second reset means may include first and second spring means, responsive to the actuating means, for returning the lever to the second position. The actuating means may include cables for engaging the ratchet drive means.

In yet another embodiment, there may be actuating means, responsive to the dual action lever, for actuating the transmission means. The transmission means may include ratchet drive means, responsive to the actuating means, for engaging the shaft. The transmission means may include gear means, responsive to the ratchet drive means, for engaging the shaft. The actuating means may include cable for engaging the ratchet drive means. There may be reset means, responsive the actuating means, for returning the lever to the second position.

This invention also features a sanitary self sealing product dispenser including a storage chamber, having an upper end and a lower end, for storing a product to be dispensed and dispensing means, adjacent the lower end, for dispensing the product. There is plunger means, having a piston and a shaft, for urging the product toward the dispensing means and a ratchet driven transmission system engaging said shaft for dispensing a predetermined amount of product.

In a preferred embodiment there may be self cleaning cutting means, adjacent the dispensing means, for simultaneously cutting the product and sealing the dispensing means. There may be a dual action lever for actuating the transmission system in a first position to dispense the product and for actuating the cutting means in a second position to cut the product and seal the dispensing means. There may be reset means, responsive to the lever, for returning the lever to the second position.

The invention also features a viscid product dispenser system including a plurality of viscid product dispensers, each said dispenser including a storage chamber, having an upper end and a lower end, for storing a product to be dispensed, dispensing means, adjacent the lower end, for dispensing the product, plunger means, having a piston and a shaft, for urging the product within the storage chamber toward the dispensing means, and a ratchet driven transmission system engaging the shaft to dispense a predetermined amount of product. There is a top portion, for covering the upper end and housing the transmission system, self-cleaning cutting means, adjacent the dispensing means, for simultaneously cutting the product and sealing the dispensing means. There is a dual action lever for actuating the transmission system in a first position to dispense the predetermined amount of product and for actuating said cutting means in a second position to cut the product and seal the dispensing means.

In a preferred embodiment there may be reset means, responsive to the lever, for returning the lever to the second position.

DISCLOSURE OF PREFERRED EMBODIMENT

Other objects, features and advantages will occur to those skilled in the art from the following description of a preferred embodiment and the accompanying drawings, in which.

Figure 1A:
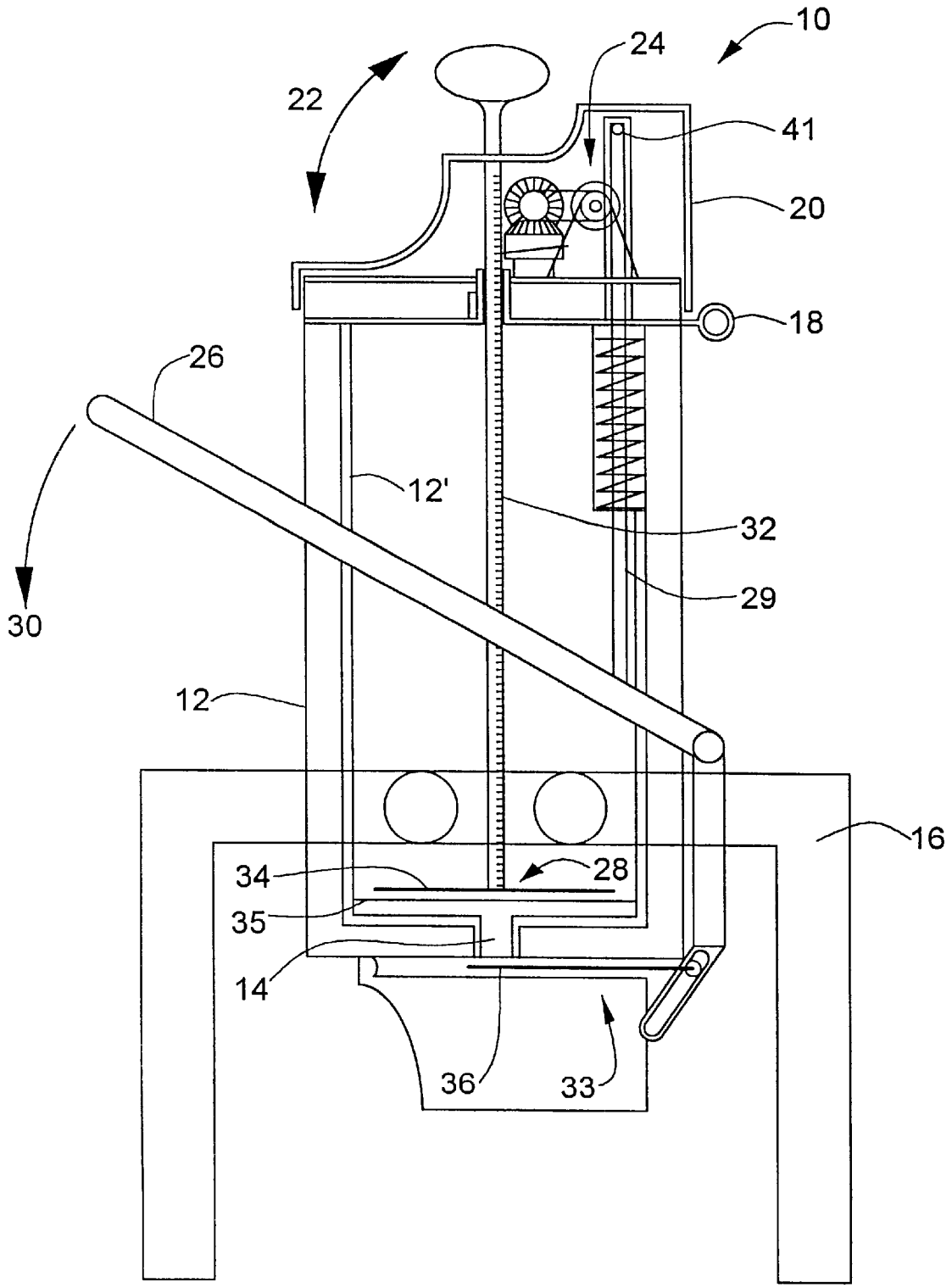
FIG. 1A is a cross sectional view of the viscid product dispenser according to the present invention in which the lever is in a predispensed position and the storage chamber is sealed.

Product dispenser 10, FIG. 1A, according to this invention includes storage chamber 12 for storing a viscous product such as jelly, peanut butter, yogurt, cream cheese and any other such product which is of such a consistency that it may be dispensed through dispensing means such as aperture 14. Base 16 provides a rigid and stable support for storage chamber 12. Hinge 18 allows cover 20 to be opened, as indicate by arrow 22, to allow product to be placed within storage chamber 12, or to allow storage chamber 12 to be cleaned.

Cover 20 also houses ratchet driven synchronous transmission system 24 which, when actuated by dual action lever 26, urges plunger means such as plunger assembly 28 downward, compressing the product toward dispensing aperture 14. As dual action lever 26 is pulled downward, indicated by arrow 30, driving means, such as driving rods 29, actuate ratchet driven transmission system 24 to engage plunger shaft 32 of plunger assembly 28 to move downward a predetermined distance to allow plunger piston 34 of plunger assembly 28 to force a measured portion of product out of dispensing aperture 14. Plunger plate 35 may be provided between piston 34 and the product being dispensed. However, this is not a necessary limitation of the invention as piston 34, were it to have the same diameter as storage chamber 12, may directly contact the product. The product to be dispensed may come prepackaged in its own compressible container, thus direct contact by the product with either plate 35 or piston 34 does not occur.

Figure 1B:
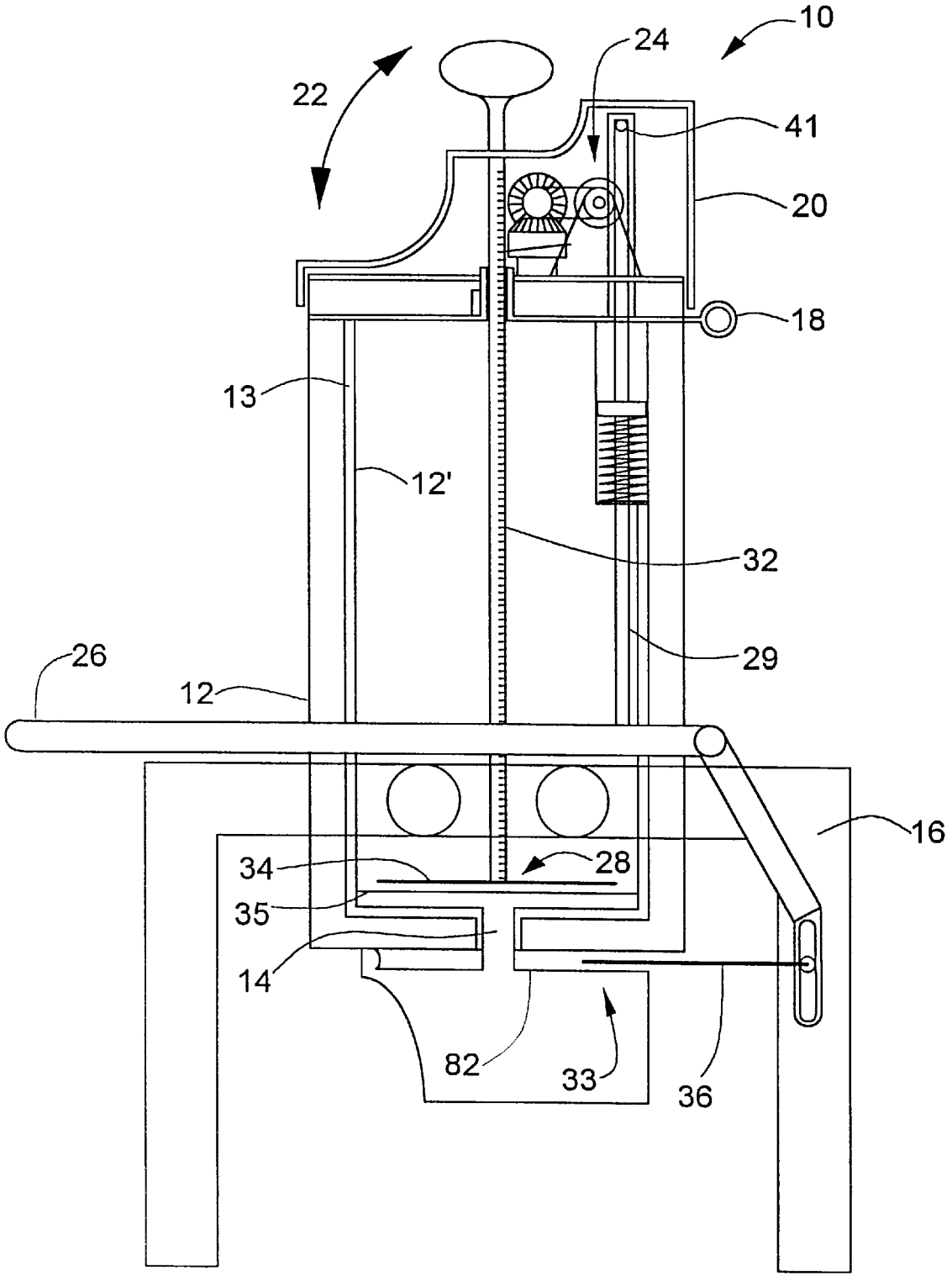
FIG. 1B is a cross sectional view of the viscid product dispenser according to the present invention in which the lever is pulled down to a dispensing position, the cutting blade retracted to unseal the storage chamber.

As dual action lever 26, FIG. 1B, is pulled downward to a first position, it simultaneously engages self cleaning cutting means 33 including blade 36 to retract from dispensing aperture 14 through blade housing 82 to allow product to be dispensed. As self cleaning cutting blade 36 retracts, any previously dispensed product residue is cleaned from the blade. When lever 26, FIG. 1A, returns to a second, or predispensed position, self cleaning cutting blade 36 cuts the product from dispensing aperture 14, sealing dispensing aperture 14, and thus storage chamber 12. The self cleaning and sealing feature of cutting means 33 provides a sanitary dispensing aperture 14 so that fresh product is always available to the next user. Storage chamber 12 may also include shell 12' which is spaced from storage chamber 12 to create space 13 which may remain empty in order to provide a layer of insulation between shell 12' and storage chamber 12 to keep the product hot or cool. Alternatively, space 13 may be filled with ice to cool the product. The amount of product dispensed, i.e. one serving, is a function of the diameter of storage chamber 12, the distance lever 26 travels and the gearing ratio of synchronous transmission 24. This allows a user to dispense a wider range of portions when actuating lever 26.

Figure 2:
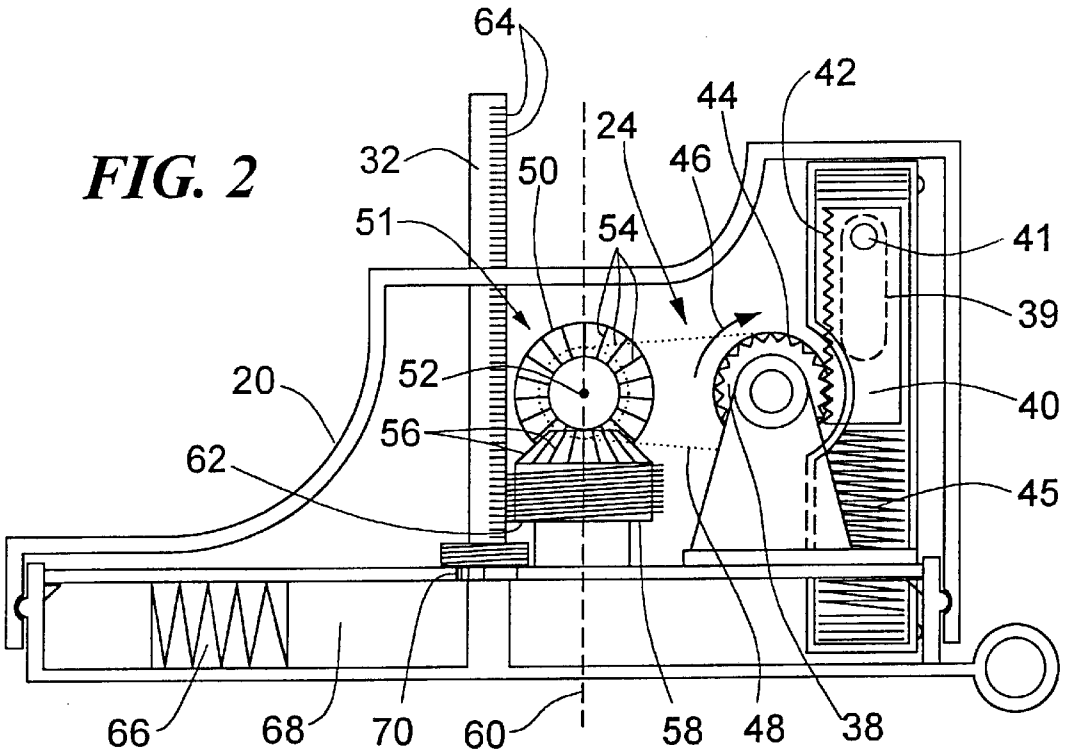
FIG. 2 is a cross sectional view of one embodiment of the ratchet driven transmission according to the present invention in which a beveled worm gear is used to drive the plunger shaft.

Synchronous transmission system 24, FIG. 2, includes ratchet drive means such as ratchet sync drive shaft 38 which is engaged by drive means, such as drive plate 40. Lever 26, FIG. 1A, is pulled downward engaging cross bar 41 which passes through opening 39, shown in phantom, of cover 20. Cross bar 41 passes through drive plate 40, thereby pulling drive plate 40 down. As drive plate 40 is pulled downward one full cycle, teeth 42 of drive plate 40 engage teeth 44 at one end of ratchet sync drive shaft 38 tuning ratchet sync drive shaft 38 in clockwise direction 46 one third revolution. While teeth 42 and 44 are shown as taper cut teeth, this is not a necessary limitation of the invention as the teeth may embody a variety of configurations well known in the art such as straight cut, rack and pinion and the like. Belt means may include belt 48, engaging the other end of ratchet sync drive shaft 38, engages gear means 51 which may include a first bevel gear 50 which rotates about axis 52 parallel to ratchet sync drive shaft 38, one half revolution. Teeth 54 of bevel gear 50 in turn engage teeth 56 of second bevel gear 58 which rotates about axis 60 perpendicular to axis 52. As discussed above, the tooth configuration may include straight cut, taper cut or helical cut teeth well known to those skilled in the art. As bevel gear 50 rotates, the engagement of teeth 54 and 56 cause bevel gear 58 to rotate one half revolution. Worm gear means such as worm teeth 62 of bevel gear 58 engage teeth 64 of plunger shaft 32 moving shaft 32 downward a predetermined amount. When lever 26, FIG. 1A, is released, reset means such as reset spring 45 returns drive plate 40, and consequently lever 26, to a predispensing position. Thus, the amount of product dispensed is a function of the length of drive plate 40, and the diameter of ratchet sync drive shaft 38, first bevel gear 50 and second bevel gear 58, as well as the pitch of their associated teeth, all of which can be readily adjusted to vary the amount of product dispensed by those skilled in the art. It should also be noted that the distance driving rods 29, FIG. 1A, are allowed to travel also affects the amount of product dispensed.

Shaft 32 is notched on one side to engage bevel gear 58. Tension spring 66 forces bushing 68 toward shaft 32 to maintain constant pressure on shaft 32 so that teeth 64 of shaft 32 remain engaged with worm teeth 62 of second bevel gear 58. The face of bushing 68 is contoured to be slightly larger than the radius of shaft 32 in order to maximize contact with shaft 32. Because shaft 32 extends through cover 20, FIG. 1A, when the product has been exhausted and more product must be added, or the dispenser must be cleaned, plunger shaft 32 must be retracted back through cover 20 so that cover 20 may be opened. Turning plunger shaft 32 in either direction, clockwise or counter clockwise, disengages teeth 64 from teeth 62 of bevel gear 58 so that plunger shaft 32 may move freely through opening 70, which is slightly larger in diameter that shaft 32, to permit shaft 32 to pass easily when disengaged from second bevel gear 58.

Figure 3:
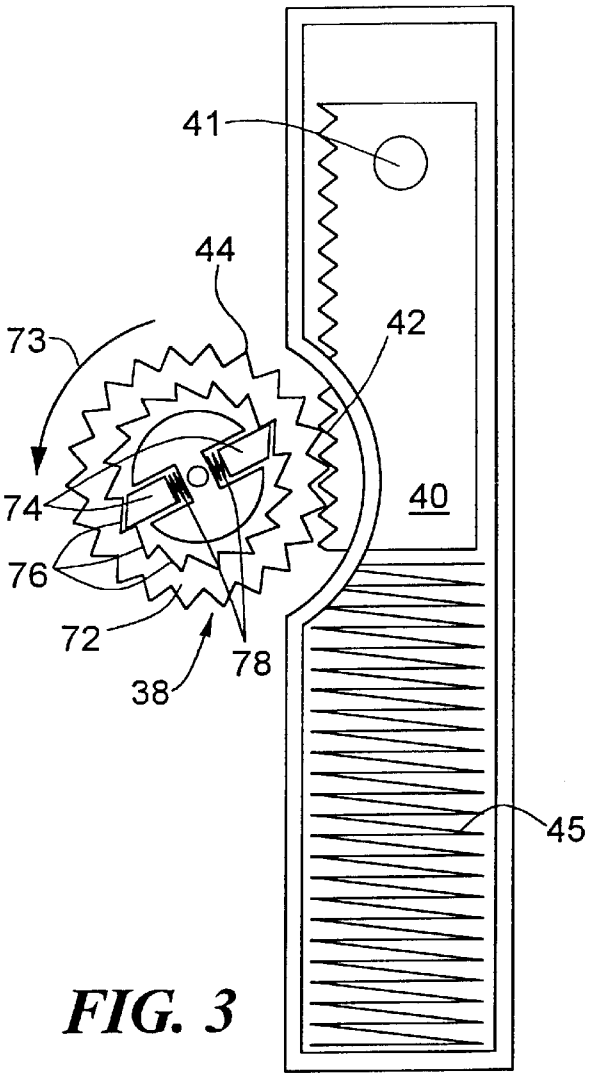
FIG. 3 is a cross sectional view of the ratchet sync drive of the ratchet driven transmission of FIG. 2 according to the present invention.

Ratchet sync drive shaft 38, FIG. 3, includes ratchet housing 72 about one end to engage drive plate 40. As drive plate 40 travels downward, engaging teeth 44, ratchet teeth 74 engage housing teeth 76, due to the outward force of ratchet springs 78, so that ratchet sync drive 38 may rotate thereby forcing plunger 28, FIG. 1B, downward to dispense product. So that plunger 28 may maintain its position within storage chamber 12 so that subsequent actuation of drive plate 40 results in a consistently measured quantity of product being dispensed each time, ratchet housing 72 is free to rotate counterclockwise 73 as drive plate 40 returns to a predispensed position without imparting rotation on ratchet sync drive shaft 38. As ratchet housing 72 rotates counterclockwise 73, housing teeth 76 pass over ratchet teeth 74 compressing ratchet springs 78. Ratchet sync drive shaft 38 is kept from rotating with ratchet housing 72 as a result of the tension created by belt 48, FIG. 2, bevel gears 50 and 52, and tension spring 66 on plunger shaft 32 within opening 70.

Figure 4:
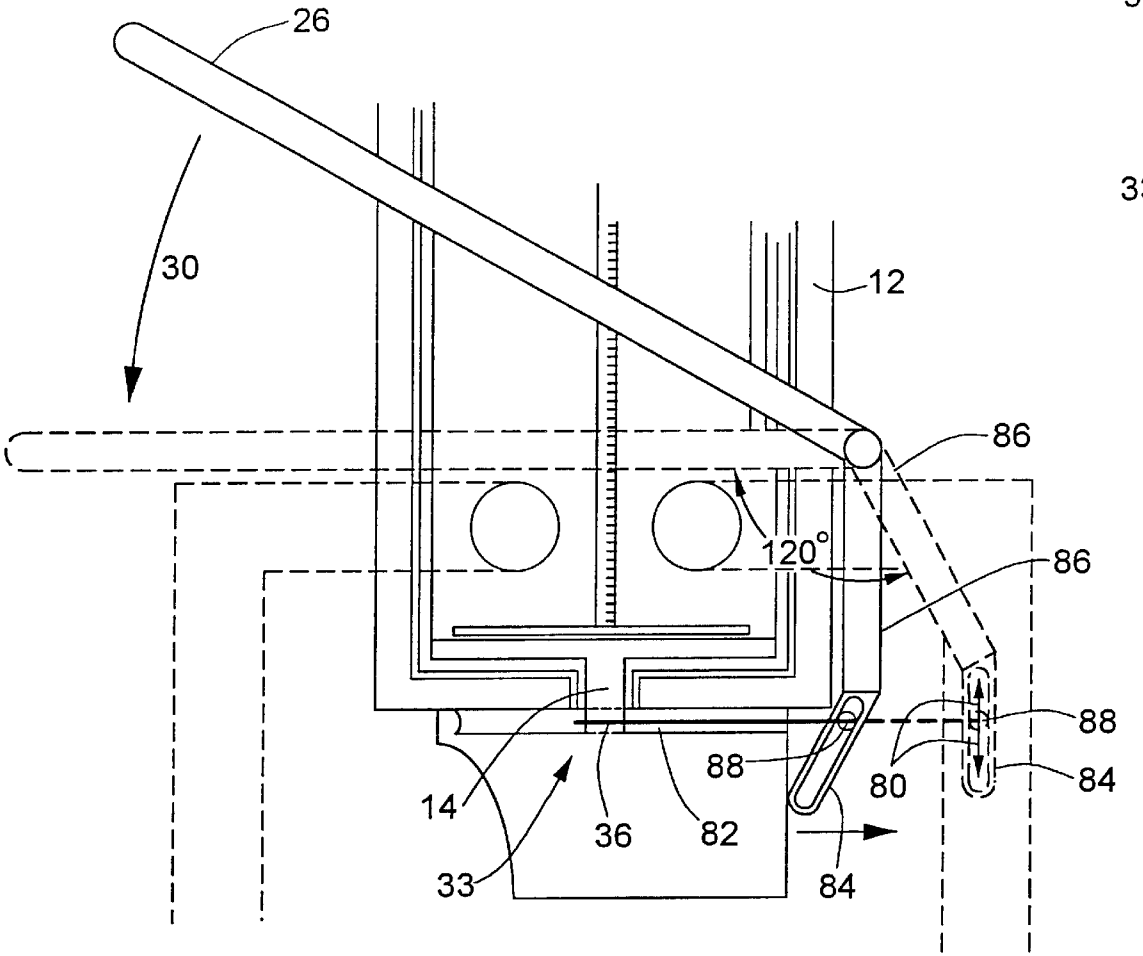
FIG. 4 is a cross sectional view of the self cleaning cutting blade according to the present invention engaged with the dual action lever.

Self sealing cutting means 33 includes cutting blade 36, FIG. 4, to seal aperture 14, and thus storage chamber 12, when lever 26, is in a predispensed position. Cutting blade 36 is housed snugly within blade housing 82 adjacent aperture 14. Cutting blade 36 is engaged by slotted hinge 84, at the end of small arm 86 of lever 26, so that as lever 26 is pulled downward, small arm 86, which is angled, for example, 120 degrees with the main portion of lever 26, withdraws cutting blade 36 from its sealed position. The slot of slotted hinge 84 allows blade pin 88 to slide freely, as indicated by arrows 80, as cutting blade 36 travels through blade housing 82 so that cutting blade 36 does not bind within housing 82, causing erratic actuation of lever 26, and possible damage to cutting blade 36.

As cutting blade 36 travels through blade housing 82, the snug fit of the blade within the housing causes any product on the blade to be cleaned from the blade.

Figure 5A:
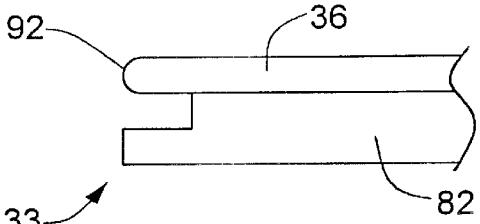
FIG. 5A is an elevational view of the cutting blade of FIG. 4 in which the blade edge includes a rounded edge.
Figure 5B:
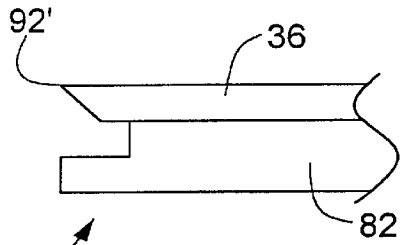
FIG. 5B is an elevational view, similar to FIG. 5A, in which the blade edge includes a sharpened edge.
Figure 5C:
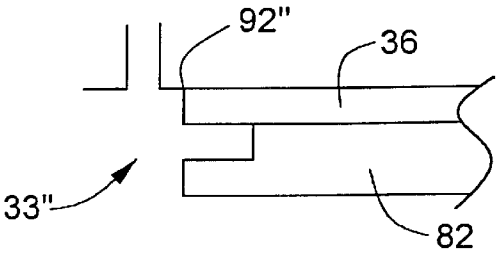
FIG. 5C is an elevational view, similar to FIG. 5A, in which the blade edge includes a sharp, squared off edge.

Cutting blade 36, FIG. 5A, is rounded for safety but may include edge 92 to assist in cutting the product. This is not a necessary limitation of the invention, as cutting blade 36, FIG. 5B, may simply be ground down to a sharp edge 92', or edge 92", FIG. 5C, may be squared off.

Figure 6B:
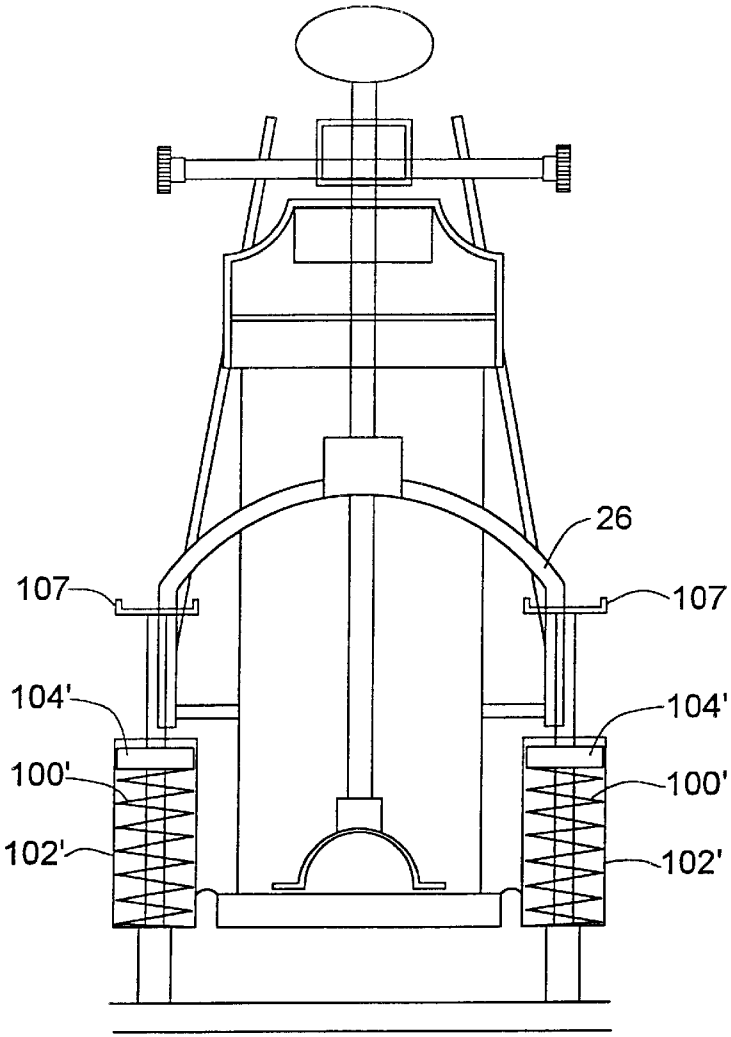
FIG. 6B is a view, similar to FIG. 6A, in which the reset spring chambers are placed below the dual action lever.
Figure 6A:
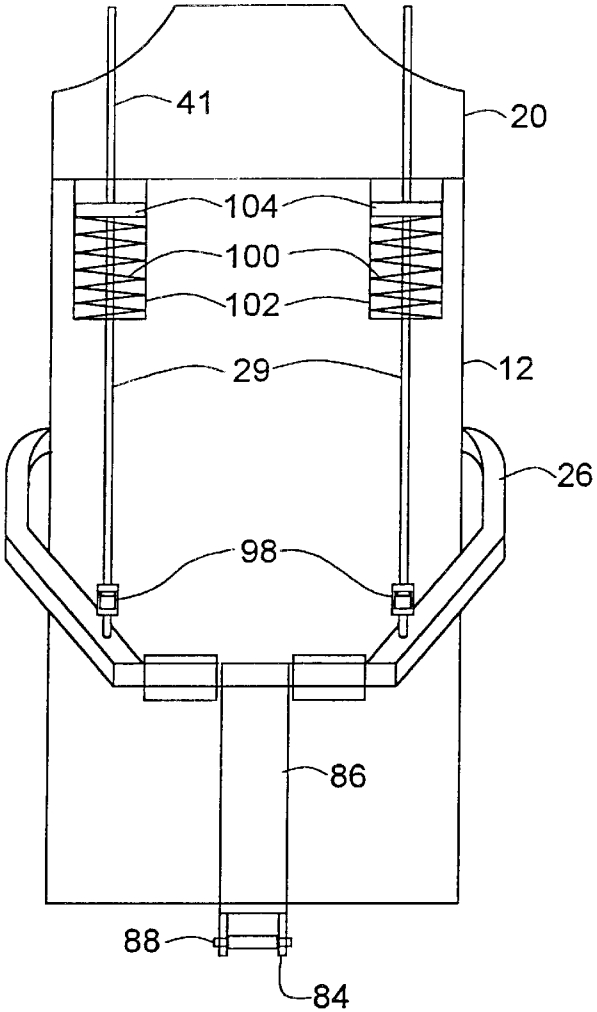
FIG. 6A is an elevational view of the driving rods of the dual action lever passing through the reset spring chambers to engage the ratchet driven transmission of FIG. 2.

Actuating means such as drive rods 29, FIG. 6A, are connected to dual action lever 26 by pivot connectors 98. However, this is not a necessary limitation to the invention as cables may also be used as shown in greater detail with reference to FIG. 6C. Pivot connectors 98 compensate for the arc of lever 26 during movement. The other ends of actuating drive rods 29 are connected to respective ends of cross bar 41 so that as dual action lever 26 is pulled down, actuating drive rods 29 pull down cross bar 41 and consequently drive plate 40, FIG. 2, setting synchronous transmission 24 in motion. Secondary reset springs 100 may be provided to assist primary reset spring 45, FIG. 2, in returning dual action lever 26 to a predispensed position. Drive rods 29 pass through reset spring chambers 102, located on storage chamber 12. Drive rods 29 pass through secondary reset springs 100 located within spring chambers 102.

Spring chamber plungers 104 on drive rods 29 compress secondary reset springs 100 as lever 26 is pulled downward. As lever 26 is released, the force of reset springs 100 pulls lever 26 upward to the predispensed position. This, however, is not a necessary limitation to the invention as reset spring chambers 102', FIG. 6B, may be placed below lever 26 such that when lever 26 is pulled downward, lever supports 107 compress reset springs 100'. As lever 26 is released, compressed reset springs 100' recoil, pushing lever 26 upward, returning it to a predispensed position.

Figure 6C:
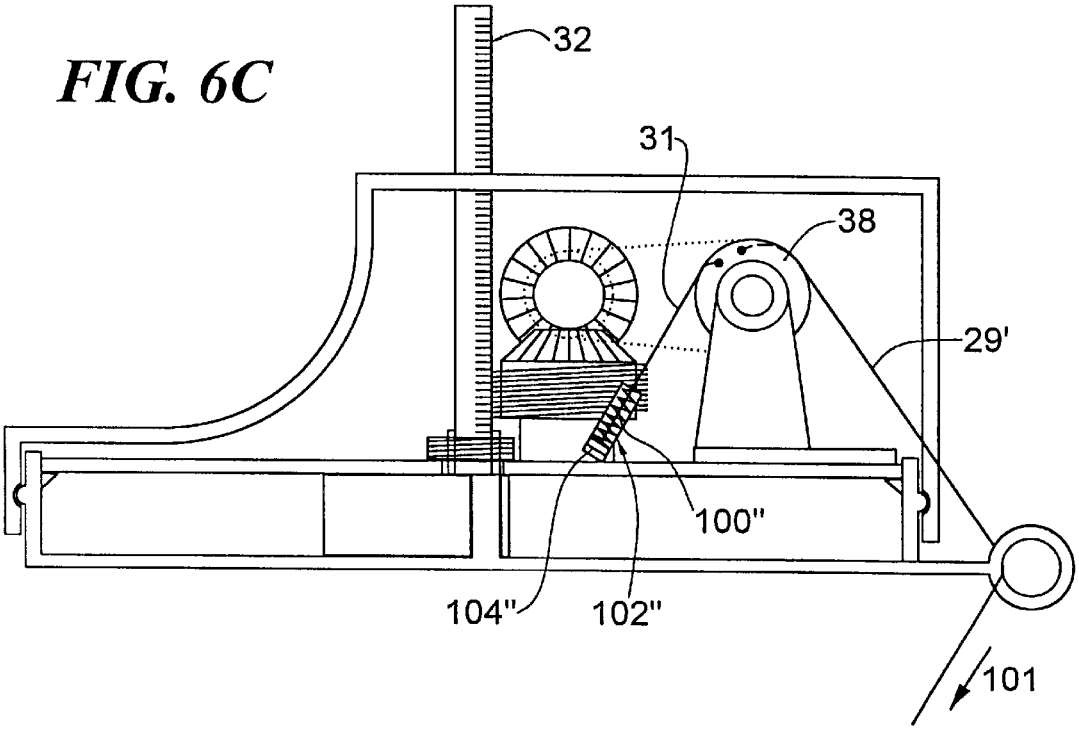
FIG. 6C is a cross sectional view, similar to FIG. 2, in which cable is used to actuate the ratchet driven transmission.

Alternatively, actuating means may include cable 29', FIG. 6C, connected to lever 26 (not shown) at one end and at the other end to ratchet sync drive shaft 38. Cable 31 is attached to drive shaft 38 at one end and at the other end to second reset spring 100" located within spring chamber 102". Spring chamber plunger 104" affixed to other end of cable 31 compresses reset spring 100" as lever 26 is pulled downward. As lever 26 is pulled down indicated by arrow 101, cable 29' engages ratchet sync drive shaft 38 to actuate shaft 32 as discussed with reference to FIG. 2. As lever 26 is released, the force of reset spring 100" pulls lever 26 upward to the predispensed position. This is not a necessary limitation of the invention, however, as cable 29' may frictionally engage ratchet synch drive shaft 38 and terminate within spring chamber 102".

Figure 7:
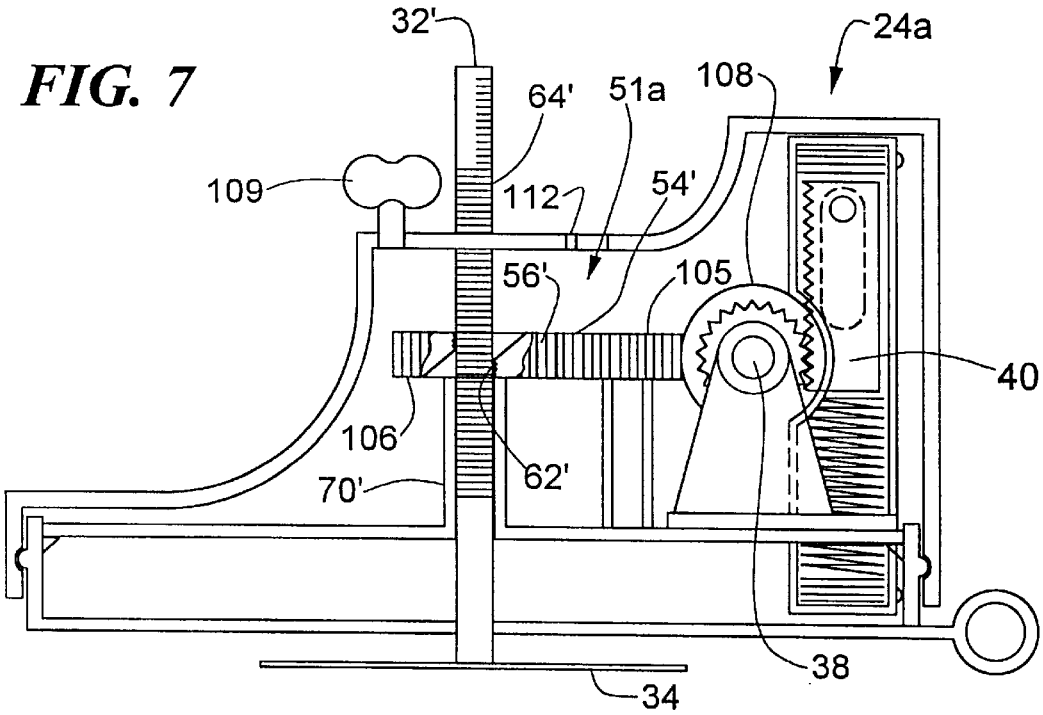
FIG. 7 is a cross sectional view of the ratchet driven transmission according to the present invention in which an altered spur gear is used to drive the plunger shaft.

The ratchet driven synchronous transmission system according to the present invention may be implemented in a number of configurations. Ratchet driven synchronous transmission system 24*a*, FIG. 7, utilizes ratchet sync drive shaft 38 and drive plate 40 as discussed above. Gear means 51*a* may include altered spur gear 106 mounted on threaded plunger shaft 32' and spur gear 105 engaging altered spur gear 106. Threads 64' of plunger shaft 32' engage threads 62' of altered spur gear 106. As drive plate 40 moves downward engaging ratchet sync drive shaft 38, worm gear means 108 of ratchet sync drive 38 engage teeth 54' of spur gear 105 causing altered spur gear 106 to rotate. Teeth 54' of spur gear 105 engage teeth 56' of altered spur gear 106 causing it to rotate thereby forcing plunger shaft 32' downward to dispense product. As discussed above, the amount of product dispensed is a function of the length of drive plate 40, and the diameter of ratchet sync drive shaft 38, spur gears 105 and 106, the tooth pitch associated with each gear and the distance traveled by lever 26.

Figure 8A:
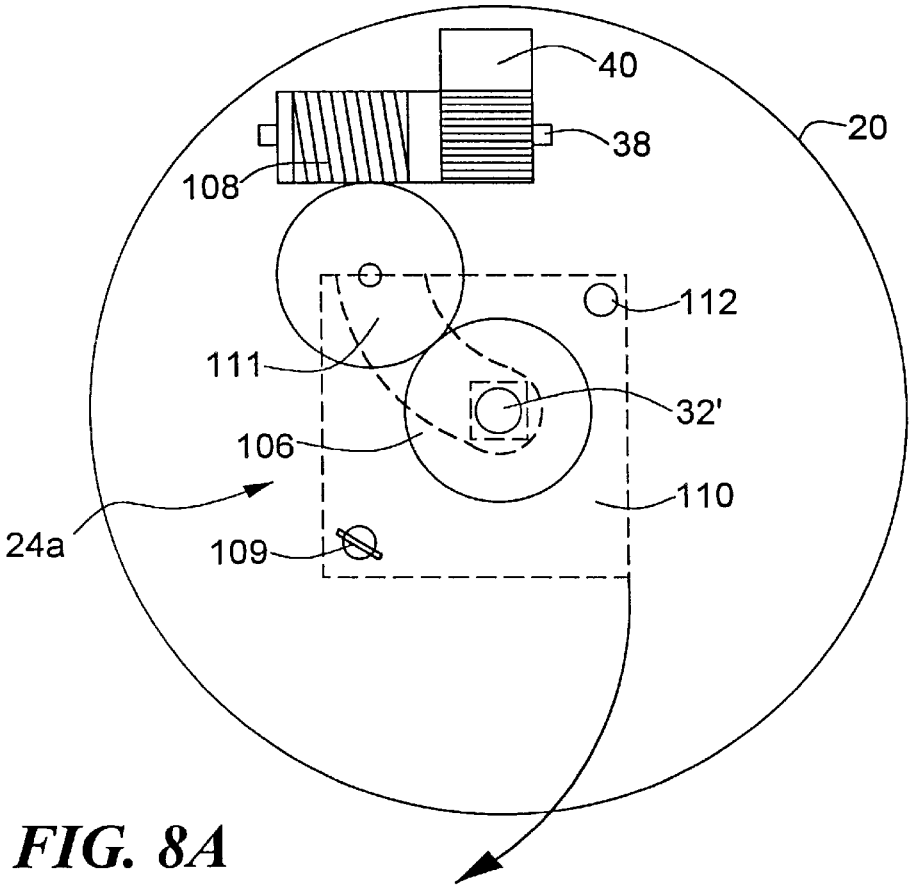
FIG. 8A is a plan view of the ratchet driven transmission of FIG. 7 in which a gear hatch permits access to the altered spur gear to permit retraction of the plunger shaft.
Figure 8B:
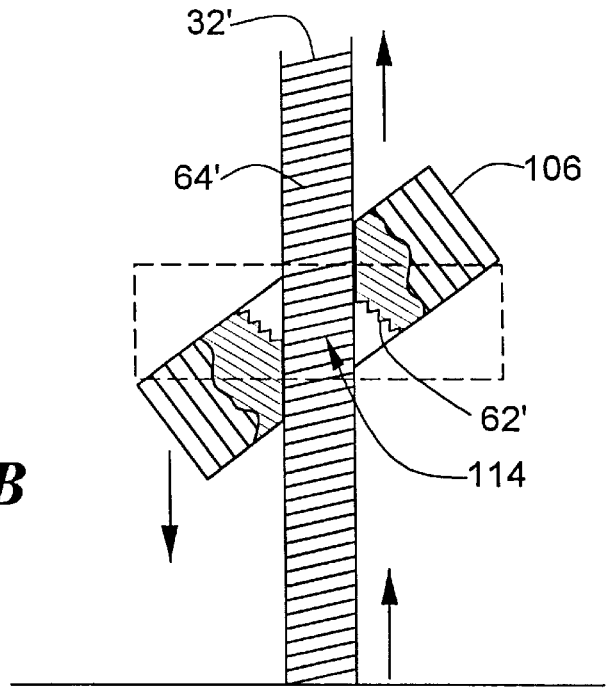
FIG. 8B is an elevational view of the altered spur gear of FIG. 7 being canted to permit repositioning of the spur gear to the base of the plunger shaft.

Plunger shaft 32' fits snugly within stem 70' to maintain engagement of teeth 56' with teeth 54' of spur gear 105. Because plunger shaft 32' is threaded completely, rather than on only one side, there is no need for bushing 68, FIG. 3, or tension spring 66. Instead, when cover 20 must be opened, hatch screw 109, FIG. 8A, for example a thumb screw, is loosened and gear hatch 110 is pivoted about hinge 112 to expose altered spur gear 106. Plunger shaft 32' may now be completely retracted and cover 20 opened. Altered spur gear 106, may then be canted 45 degrees, FIG. 8B, due to altered opening 114, to disengage threads 62' and 64'. Altered opening 114 is wide enough to permit quick and easy passage of plunger shaft 32' through opening 114. Once plunger assembly 28 has been completely retracted, altered spur gear 106 may be returned to the bottom of plunger shaft 32' and teeth 56' of altered spur gear 106 re-engage with teeth 54' of spur gear 105 and threads 62' of spur gear 106 reengage with threads 64' of plunger shaft 32'. Gear hatch 110, FIG. 8A, is pivoted about hinge 112 and screw 109 secures gear hatch 110 in the closed position. Once cover 20 is closed, dispenser 10, FIG. 1A, is ready to be used.

Figure 9:
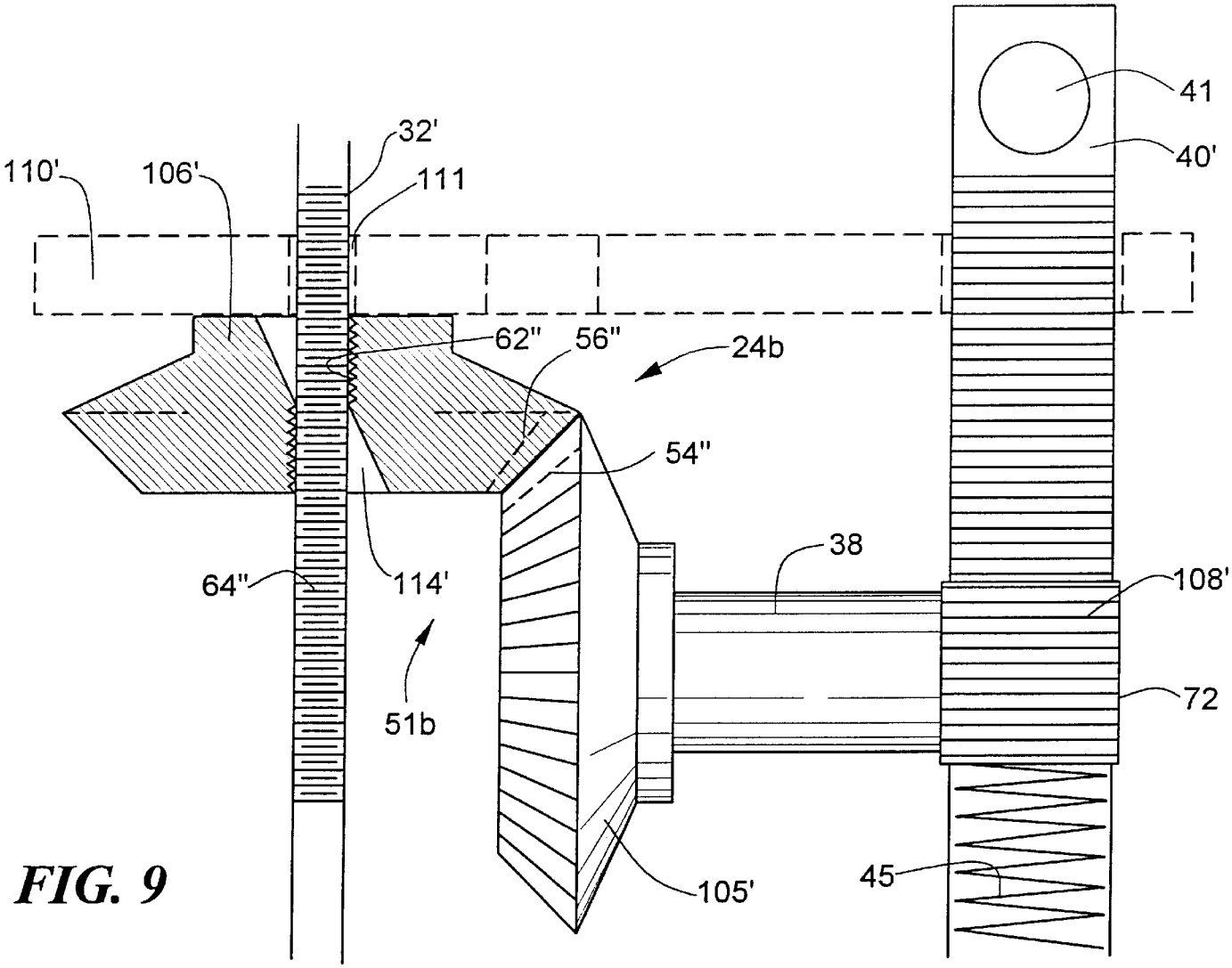
FIG. 9 is a cross sectional view of the ratchet driven transmission according to the present invention in which an altered bevel gear drives the plunger shaft.

Ratchet driven transmission system 24*b*, FIG. 9, utilizes ratchet sync drive shaft 38 and drive plate 40'. Drive plate 40' may be a rack and ratchet housing 72 may be a pinion gear. However, this is not a necessary limitation as the teeth of drive plate 40' and ratchet housing 72 may include any tooth configuration well known in the art. Gear means 51*b* may include altered bevel gear 106', mounted on threaded plunger shaft 32', and bevel gear 105' engaging altered bevel gear 106'. Threads 64" of plunger shaft 32' engage threads 62" of altered bevel gear 106'. As drive plate 40' moves downward engaging pinion gear means 108' of ratchet sync drive shaft 38, bevel gear 105', mounted on one end of ratchet sync drive 38, causes altered bevel gear 106' to rotate. Teeth 54" of bevel gear 105' engage teeth 56" of altered bevel gear 106' causing it to rotate thereby forcing plunger shaft 32' downward to dispense product. As discussed above, the amount of product dispensed is a function of the length of drive plate 40', and the diameter of ratchet sync drive shaft 38, bevel gears 105' and 106' and the tooth pitch associated with each gear.

Figure 10:
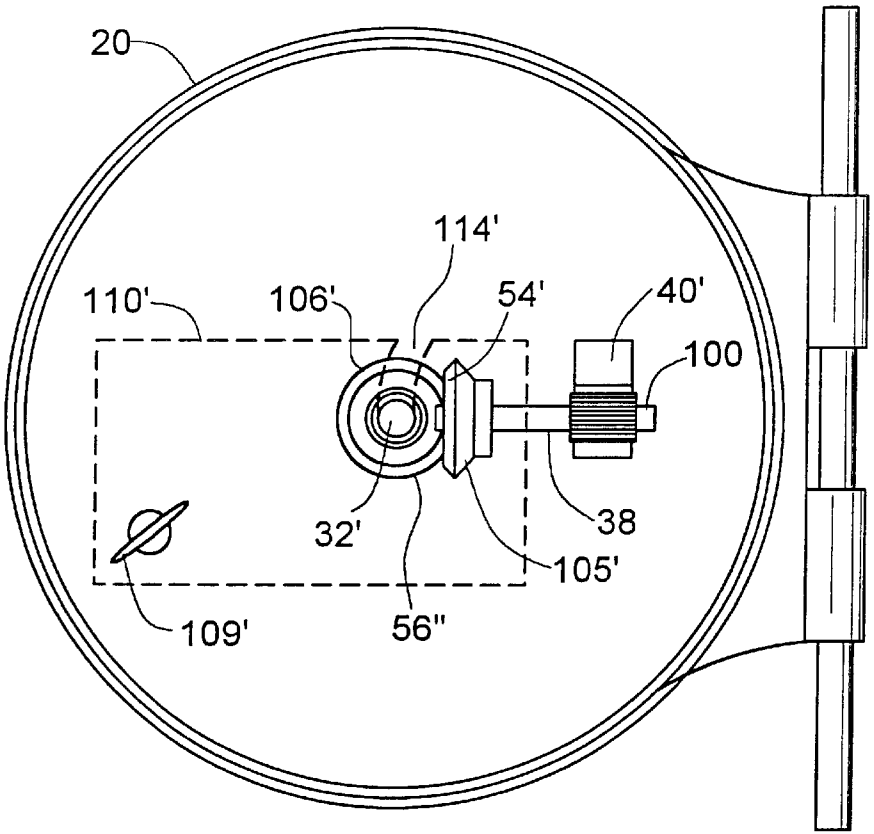
FIG. 10 is a plan view of the ratchet driven transmission of FIG. 9 in which a gear hatch permits access to the altered bevel gear to permit retraction of the plunger.

Plunger shaft 32', FIG. 10, fits snugly within slot 111 of hatch 110'. The pressure of closed hatch 110' on altered bevel gear 106' maintains engagement of teeth 56" of altered bevel gear 106' with teeth 54" of bevel gear 105'. Because plunger shaft 32' is threaded completely, rather than on only one side, there is no need for bushing 68, FIG. 3, or tension spring 66. Instead, when cover 20 must be opened, hatch screw 109', for example a thumb screw, is loosened and gear hatch 110' is pivoted about hinge 112' to expose altered bevel gear 106'. Alternatively, hinge 112' may be eliminated and hatch 110' removed by loosening hatch screw 109'. Plunger shaft 32' may now be completely retracted and cover 20 opened. Altered bevel gear 106', may then be canted 45 degrees, as discussed above with reference to FIG. 8B, due to altered opening 114', to disengage threads 62" and 64". Altered opening 114' is wide enough to permit quick and easy passage of plunger shaft 32' through opening 114'. Once plunger assembly 28 has been completely retracted, altered bevel gear 106' may be returned to the bottom of plunger shaft 32' and teeth 56" of altered bevel gear 106' reengage with teeth 54" of bevel gear 105' and threads 62" of altered bevel gear 106' re-engage with threads 64" of plunger shaft 32'. Gear hatch 110' is pivoted about hinge 112' and screw 109' secures gear hatch 110' in the closed position. Once cover 20 is closed, dispenser 10, FIG. 1A, is ready to be used.

Figure 11:
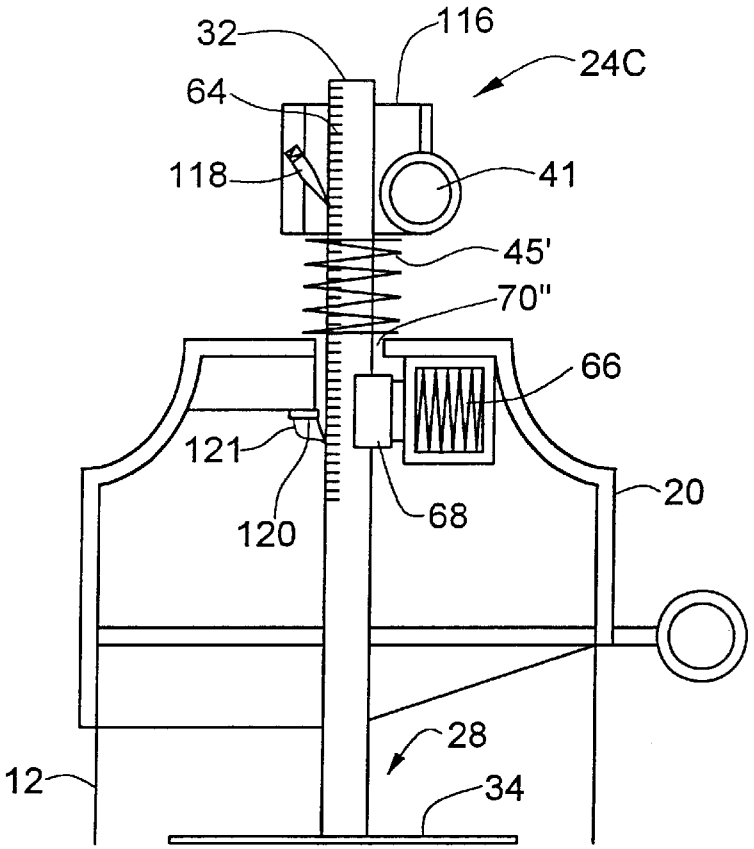
FIG. 11 is a cross sectional view of the ratchet driven transmission in which a spring loaded pawl is used to drive the plunger shaft downward.

In yet another embodiment, cross bar 41, FIG. 11, engages rachet driven transmission system 24*c* which may include sliding ring 116 mounted about plunger shaft 32 with teeth 64 on one side as in FIG. 3. As cross bar 41 is pulled downward, spring loaded pawl 118 within sliding ring 116 engages teeth 64 of shaft 32 forcing shaft 32 downward thereby forcing plunger assembly 28 downward to dispense product. Thus, the distance traveled by lever 26 is transferred into downward travel of shaft 32 to dispense a measured amount of product.

Reset spring 45' returns sliding ring 116 to a predispensed position. Second spring loaded pawl 120, within cover 20, prevents shaft 32 from traveling with sliding ring 116 when lever 26, FIG. 1A, is released to maintain the position of plunger 28 within storage chamber 12 so that subsequent actuation of lever 26 results in a consistently measured quantity of product being dispensed. Tension spring 66 forces bushing 68 toward shaft 32 to maintain constant pressure on shaft 32 so that teeth 64 of shaft 32 remain engaged with pawl 120. Similarly, spring 121 also maintains pawl 120 engaged with shaft 32. As discussed above with reference to FIG. 3, because shaft 32 extends through cover 20, plunger shaft 32 must be retracted back through cover 20 so that cover 20 may be opened. Turning plunger shaft 32 in either direction, clockwise or counter clockwise, disengages teeth 64 from pawls 118 and 120 so that plunger shaft 32 may move freely through opening 70 and retracted.

Figure 12:
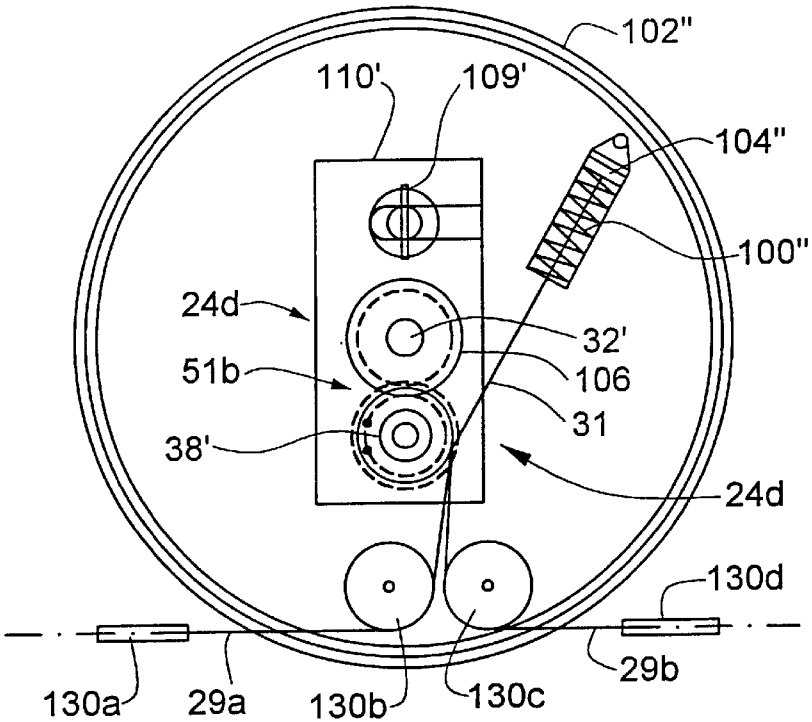
FIG. 12 is a plan view of the ratchet driven transmission according to the present invention in which cables drive the transmission.

In still another embodiment, actuating cables 29*a* and 29*b*, FIG. 12, engage ratchet sync drive shaft 38' of ratchet driven synchronous transmission 24*d* via pulleys 130*a–d*. Ratchet sync drive shaft 38' is similar to ratchet sync drive shaft 38, FIGS. 2 and 3, but oriented parallel rather than transverse to shaft 32'.

Actuating cables 29*a* and 29*b* are fixed at their ends to ratchet sync drive shaft 38'. Actuating cable 31 is fixed at one end to drive shaft 38' and the other end is terminated in spring chamber 102". This is not a necessary limitation of the invention as cables 29*a, b* may frictionally engage drive shaft 38' and terminate in spring chamber 102". As lever 26 is pulled downward, spring chamber plunger 104" compresses reset spring 100" located within spring chamber 102". Spring chamber plunger 104" affixed to the other end of actuating cable 31 compresses reset spring 100" as lever 26 is pulled downward. As lever 26 is released, the force of reset spring 100" pulls lever 26 upward to the predispensed position.

Figure 13:
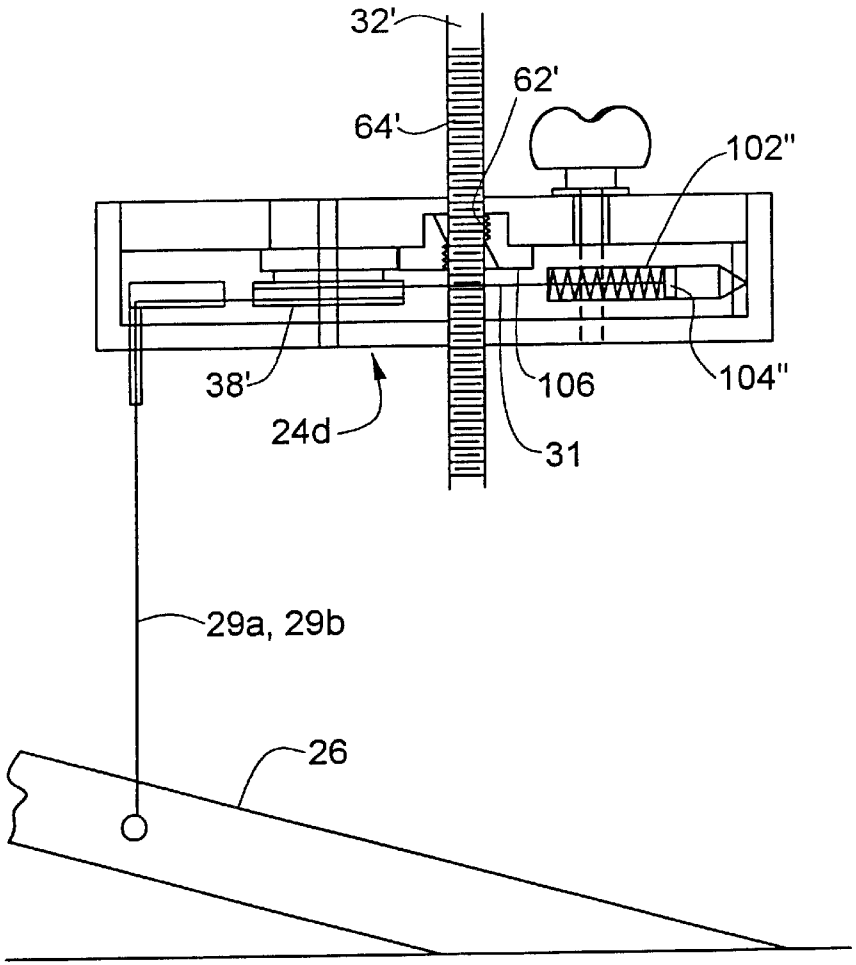
FIG. 13 is a cross sectional view of the ratchet driven transmission of FIG. 12.

As lever 26, FIG. 13, is pulled downward, cables 29*a* and 29*b* engage ratchet sync drive shaft 38', which in turn engages alterated spur gear 106. Threads 62' of alterated spur gear 106 engage threads 64' of shaft 32' to drive plunger assembly 28 downward as discussed in FIG. 7. Plunger shaft 32' may be retracted by canting alterated spur gear 106 as discussed in reference to FIGS. 8A and 8B.

Figure 14:
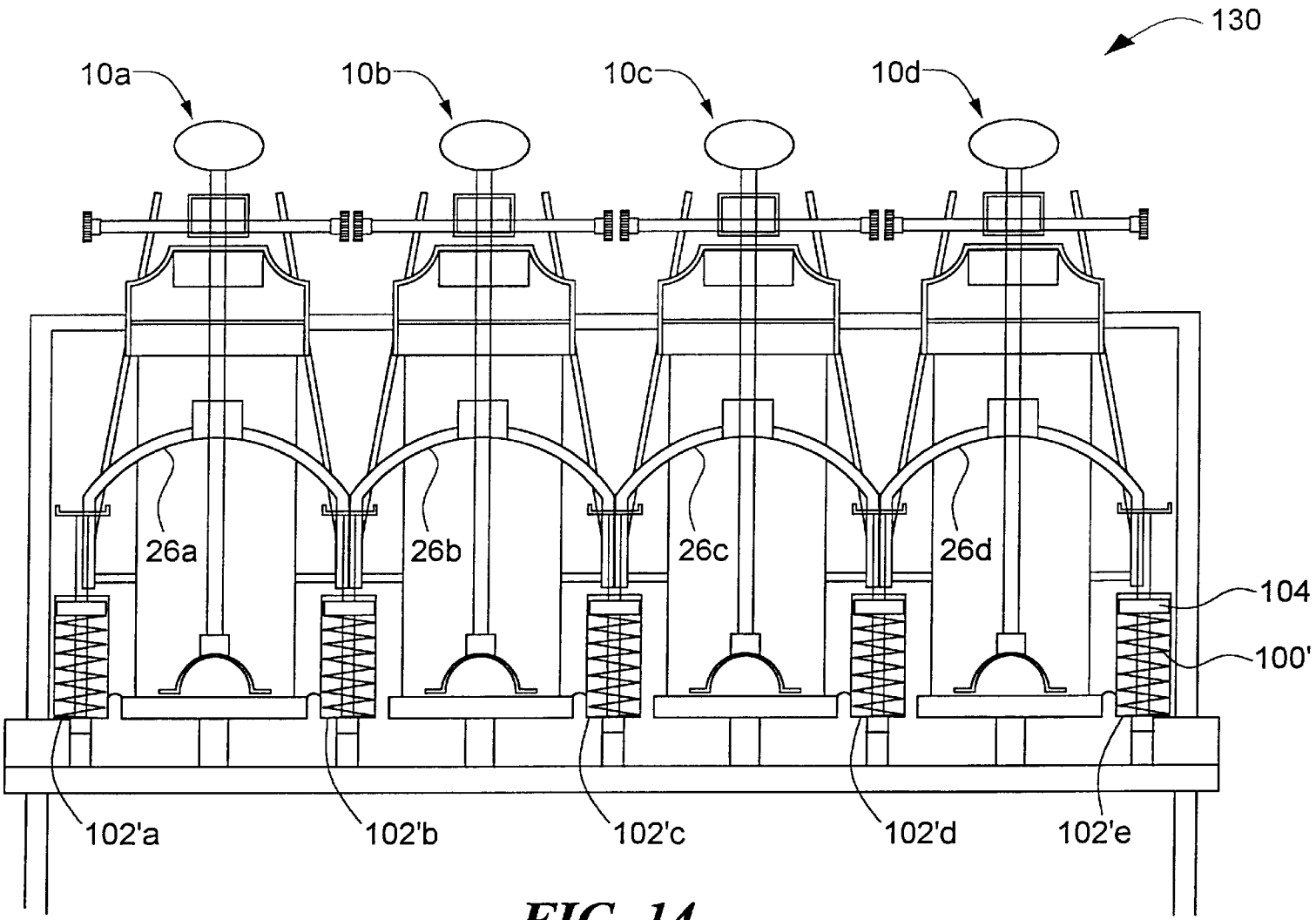
FIG. 14 is an elevational view of a viscid product dispensing system using a plurality of viscid product dispensers according to the present invention.

Viscid product dispensing system 130, FIG. 14, includes a plurality of viscid product dispensers 10*a*–10*d*. By combining dispensers 10*a*–10*d*, and using reset spring chambers below levers 26*a*–26*d*, fewer parts are required, as levers 26*a*–26*d* may share reset spring chambers 102'*b–d*. Moreover, viscid product dispensing system 130, while having the same advantages of four individual dispensers, takes up less space than four individual dispensers of the same construction, i.e. lower reset spring chambers, which is important when space is limited. Dispensers 10*a*–10*d* operate independently, despite sharing reset spring chambers 102'*b–d*. This is not a necessary limitation of the invention, however, as product dispensers having their reset spring chambers mounted above the dual action lever may also be used.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A sanitary self sealing viscid product dispenser comprising:

a storage chamber, having an upper end and a lower end, for storing a product to be dispensed;

dispensing means, adjacent said lower end, for dispensing said product;

plunger means, having a piston and a shaft, for urging said product toward said dispensing means;

a ratchet driven transmission system engaging said shaft for dispensing a predetermined amount of said product;

a top portion, for covering said upper end and housing said transmission system;

self-cleaning cutting means, adjacent said dispensing means, for simultaneously cutting said product and sealing said dispensing means;

a dual action lever for actuating said transmission system in a first position to dispense said predetermined amount of said product and for actuating said cutting means in a second position to cut said product, sealing said dispensing means;

reset means, responsive to said lever, for returning said lever to said second position; and drive means, responsive to said lever, for actuating said transmission means.

2. The viscid product dispenser of claim 1 further including actuating means, responsive to said dual action lever, for actuating said drive means.

3. The viscid product dispenser of claim 2 in which said transmission system includes ratchet drive means, responsive to said drive means, for engaging said shaft.

4. The viscid product dispenser of claim 3 in which said transmission system further includes gear means, responsive to said ratchet drive means, for engaging said shaft.

5. The viscid product dispenser of claim 4 in which said gear means includes a first gear for engaging said shaft and a second gear for engaging said first gear and said ratchet drive means.

6. The viscid product dispenser of claim 5 in which said drive means includes a drive plate, responsive to said actuating means, for actuating said ratchet drive means.

7. The viscid product dispenser of claim 6 in which said shaft is notched.

8. The viscid product dispenser of claim 7 in which said first gear includes worm gear means for engaging said shaft and bevel gear means for engaging said second gear.

9. The viscid product dispenser of claim 8 further including belt means, responsive to said ratchet drive means, for engaging said second gear.

10. The viscid product dispenser of claim 9 further including second reset means, responsive to said actuating means, for returning said lever to said second position.

11. The viscid product dispenser of claim 10 in which said lever includes a lower arm for actuating said cutting means.

12. The viscid product dispenser of claim 11 in which said lower arm includes a slotted hinge for actuating said cutting means.

13. The viscid product dispenser of claim 12 in which said cutting means includes a cutting blade for cutting said product.

14. The viscid product dispenser of claim 13 in which said cutting means further includes a cutting blade housing, for cleaning said blade.

15. The viscid product dispenser of claim 14 in which said blade includes a rounded cutting edge.

16. The viscid product dispenser of claim 14 in which said blade includes a beveled cutting edge.

17. The viscid product dispenser of claim 13 in which said blade includes a squared cutting edge.

18. The viscid product dispenser of claim 13 in which said reset means includes spring means, responsive to said drive plate, for returning said lever to said second position.

19. The viscid product dispenser of claim 18 in which said second reset means includes first and second spring means, responsive to said actuating means, for returning said lever to said second position.

20. The viscid product dispenser of claim 6 in which said shaft is threaded.

21. The viscid product dispenser of claim 20 in which said first gear includes an altered spur gear for engaging said shaft.

22. The viscid product dispenser of claim 21 in which said second gear includes a spur gear for engaging said altered spur gear and said ratchet drive means.

23. The viscid product dispenser of claim 22 in which said ratchet drive means includes worm gear means for engaging said second gear.

24. The viscid product dispenser of claim 23 further including second reset means, responsive to said actuating means, for returning said lever to said second position.

25. The viscid product dispenser of claim 24 in which said lever includes a lower arm for actuating said cutting means.

26. The viscid product dispenser of claim 25 in which said lower arm includes a slotted hinge for actuating said cutting means.

27. The viscid product dispenser of claim 26 in which said cutting means includes a cutting edge for cutting said product.

28. The viscid product dispenser of claim 27 in which said cutting means further includes a cutting blade housing, for cleaning said blade.

29. The viscid product dispenser of claim 28 in which said blade includes a rounded cutting edge.

30. The viscid product dispenser of claim 28 in which said blade includes a beveled cutting edge.

31. The viscid product dispenser of claim 28 in which said blade includes a squared cutting edge.

32. The viscid product dispenser of claim 27 in which said reset means includes spring means, responsive to said drive plate, for returning said lever to said second position.

33. The viscid product dispenser of claim 32 in which said second reset means includes first and second spring means, responsive to said actuating means, for returning said lever to said second position.

34. The viscid product dispenser of claim 20 in which said first gear includes an altered bevel gear for engaging said shaft.

35. The viscid product dispenser of claim 34 in which said second gear includes a bevel gear for engaging said altered bevel gear and said ratchet drive means.

36. The viscid product dispenser of claim 35 in which second gear engages said ratchet drive means by being mounted on one end of said ratchet drive means.

37. The viscid product dispenser of claim 3 in which said ratchet drive means includes a slide ring, responsive to said actuating means, for engaging said shaft.

38. The viscid product dispenser of claim 37 in which said slide ring includes a spring loaded pawl for engaging said shaft.

39. The viscid product dispenser of claim 38 in which said reset means includes spring means, responsive to said slide ring, for returning said lever to said second position.

40. This viscid product dispenser of claim 39 in which said ratchet drive means further includes a second spring loaded pawl for maintaining said shaft in a fixed position as said reset means returns said lever to said second position.

41. The viscid product dispenser of claim 40 further including second reset means, responsive to said actuating means, for returning said lever to said second position.

42. The viscid product dispenser of claim 41 in which said lever includes a lower arm for actuating said cutting means.

43. The viscid product dispenser of claim 42 in which said lower arm includes a slotted hinge for actuating said cutting means.

44. The viscid product dispenser of claim 43 in which said cutting means includes a cutting blade for cutting said product.

45. The viscid product dispenser of claim 44 in which said cutting means further includes a cutting blade housing, for cleaning said blade.

46. The viscid product dispenser of claim 45 in which said blade includes a rounded cutting edge.

47. The viscid product dispenser of claim 45 in which said blade includes a beveled cutting edge.

48. The viscid product dispenser of claim 45 in which said blade includes a squared cutting edge.

49. The viscid product dispenser of claim 44 in which said reset means includes spring means, responsive to said slide ring, for returning said lever to said second position.

50. The viscid product dispenser of claim 49 in which said second reset means includes first and second spring means, responsive to said actuating means, for returning said lever to said second position.

51. The viscid product dispenser of claim 4 in which said shaft is threaded.

52. The viscid product dispenser of claim 51 in which said gear means include an altered spur gear.

53. The viscid product dispenser of claim 52 in which said ratchet drive means includes spur gear means for engaging said altered spur gear.

54. The viscid product dispenser of claim 53 further including reset means, responsive to said actuating means, for returning said lever to said second position.

55. The viscid product dispenser of claim 53 in which said actuating means includes cable for engaging said ratchet drive means.

56. A viscid product dispensing system comprising:

a plurality of viscid product dispensers, each said dispenser comprising;

a storage chamber, having an upper end and a lower end, for storing a product to be dispensed;

dispensing means, adjacent said lower end, for dispensing said product;

plunger means, having a piston and a shaft, for urging said product toward said dispensing means;

a ratchet driven transmission system engaging said shaft for dispensing a predetermined amount of said product;

a top portion, for covering said upper end and housing said transmission system;

self-cleaning cutting means, adjacent said dispensing means, for simultaneously cutting said product and sealing said dispensing means; and a dual action lever for actuating said transmission system in a first position to dispense said predetermined amount of said product and for actuating said cutting means in a second position to cut said product, sealing said dispensing means.

57. The viscid product dispensing system of claim 56 further including reset means, responsive to said lever, for returning said lever to said second position.

58. A sanitary self sealing viscid product dispenser comprising:

a storage chamber, having an upper end and a lower end, for storing a product to be dispensed;

dispensing means, adjacent said lower end, for dispensing said product;

plunger means, having a piston and a shaft, for urging said product toward said dispensing means;

a ratchet driven transmission system engaging said shaft for dispensing a predetermined amount of said product;

a top portion, for covering said upper end and housing said transmission system;

self-cleaning cutting means, adjacent said dispensing means, for simultaneously cutting said product and sealing said dispensing means; and a dual action lever for actuating said transmission system in a first position to dispense said predetermined amount of said product and for actuating said cutting means in a second position to cut said product, sealing said dispensing means.

59. The viscid product dispenser of claim 58 further including reset means, responsive to said lever, for returning said lever to said second position.

60. The viscid product dispenser of claim 58 further including actuating means, responsive to said dual action lever, for actuating said transmission system.

61. The viscid product dispenser of claim 60 in which said transmission system further includes gear means, responsive to said ratchet drive means, for engaging said shaft.

62. The viscid product dispenser of claim 61 in which said actuating means includes cable for engaging said ratchet drive means.

63. The viscid product dispenser of claim 62 further including reset means, responsive to said actuating means for returning said lever to said second position.

* * * * *